US007591044B2

(12) United States Patent
Migli

(10) Patent No.: US 7,591,044 B2
(45) Date of Patent: Sep. 22, 2009

(54) HINGE FOR FURNITURE WITH A LOW THICKNESS AND IMPROVED STRUCTURE

(75) Inventor: Carlo Migli, Lecco (IT)

(73) Assignee: Agostino Ferrari

( * ) Notice: Subject to any disclaimer, the term of this patent is extended or adjusted under 35 U.S.C. 154(b) by 322 days.

(21) Appl. No.: 11/254,908

(22) Filed: Oct. 20, 2005

(65) Prior Publication Data

US 2006/0236503 A1 Oct. 26, 2006

(30) Foreign Application Priority Data

Apr. 21, 2005 (IT) ..... MI20050138 U

(51) Int. Cl.
*E05D 7/04* (2006.01)

(52) U.S. Cl. ..... 16/235; 16/238; 16/242

(58) Field of Classification Search ..... 16/235, 16/236, 237, 238, 243, 246, 242, 245; 49/195, 49/176, 177; 312/300, 302, 311, 322
See application file for complete search history.

(56) References Cited

U.S. PATENT DOCUMENTS 5,930,866 A * 8/1999 Rupprechter ..... 16/242
6,470,531 B2 * 10/2002 Domenig et al. ..... 16/240
6,694,567 B1 * 2/2004 Domenig et al. ..... 16/238
6,779,233 B2 * 8/2004 Migli ..... 16/246
6,880,205 B2 * 4/2005 Rupprechter ..... 16/235
6,918,158 B2 * 7/2005 Isele ..... 16/235
7,017,231 B2 * 3/2006 Isele ..... 16/242
7,213,300 B1 * 5/2007 Domenig et al. ..... 16/236
2003/0093877 A1 * 5/2003 Hofer ..... 16/235
2004/0163211 A1 * 8/2004 Rucker ..... 16/235

* cited by examiner

*Primary Examiner*—Victor Batson
*Assistant Examiner*—Jeffrey O'Brien
(74) *Attorney, Agent, or Firm*—Shlesinger & Fitzsimmons

(57) ABSTRACT

A hinge for furniture of the "frame" type comprises a base portion to be mounted to the frame of the piece of furniture and a portion for fastening to the furniture door and articulated on the base portion. The base portion comprises a lower element intended for fastening to the furniture frame, and an upper element supporting the articulation to the portion fastening the hinge to the door. The lower and upper elements are connected to each other for mutual-sliding movement in a direction longitudinal to the hinge, means for controlled adjustment of the sliding movement being present close to one end of the base portion. The two base elements are made of cut-out sheet metal and means for sliding constraint in the adjustment direction are present between them, said means comprising half-punched pins projecting from side walls of one of the two elements for sliding fitting into corresponding slots in the other element.

9 Claims, 3 Drawing Sheets

HINGE FOR FURNITURE WITH A LOW THICKNESS AND IMPROVED STRUCTURE

BACKGROUND OF THE INVENTION

1. Field of the Invention

The present invention relates to a hinge for furniture of the "frame" type provided with an improved structure and low thickness.

2. State of the Prior Art

For furniture built following the known load-bearing front frame system (widespread above all on the American market), single-pin hinges provided with position adjustment are more and more often required. The maximum adjustment capability is represented by the possibility of moving the furniture door in the three orthogonal spatial directions. To obtain this type of adjustment in a correct manner the hinge must be provided with three distinct operating members.

A further requirement consists in reducing the hinge thickness so as to obtain a minimum bulkiness inside the piece of furniture. The last-mentioned point is of great importance in making furniture for the American market for example, where the "frame" type construction already constitutes an important reduction to the piece of furniture opening.

A typical hinge construction for the frame system comprises a base portion to be fastened to the piece of furniture and pivotally mounted to a hinge box to be embedded into the furniture door. For maximum adjustment, the base portion is formed with two elements or plates slidably coupled with each other by a cam (or a screw) to supply front adjustment of the hinge. The innermost element is screwed on the frame edge by a fastening screw enabling vertical adjustment of the hinge position. The outermost element has one end bent at a right angle slidably supporting an arm pivotally mounted to the box (again with a cam or screw), so as to also enable a side adjustment of the position.

For reasons connected with the frame sizes, the cam for adjustment between the two base elements is usually located behind the fastening screw seat of the inner element on the frame. Therefore, riveting by which the cam axially locks the two components is not sufficient to ensure a good holding between the two components because said cam is disposed too rearwardly.

Consequently, for steady fastening it is necessary to create another coupling point on the forward part of the base relative to the fastening screw. This coupling must lock the two base components in the direction of the cam axis and, simultaneously, allow free longitudinal displacement of the two components for front adjustment. According to the known art, this coupling is obtained through formation of a pair of transversely aligned holes in one of the two components (in the fixed part of the piece of furniture, for example) and a pair of slots aligned with the holes and elongated in the front adjustment direction in the other component. A pin is inserted through the holes and slots and locked to the holes for transverse sliding along the slots, so as to obtain fastening between the two plates while at the same time maintaining a possibility of adjustment between the two parts of the base.

This solution however has some drawbacks. First of all use of another component (the pin) is made necessary so that the pin cost and the difficulties and costs for mounting of the pin are to be added.

In addition, for clear die-forming reasons, the hole must be made to a suitable distance from the upper wall of the fixed plate (the material width between the hole and edge should not be smaller than the material thickness). Due to the above, the overall height of the movable plate and therefore the hinge bulkiness within the frame opening cannot go below a minimum value (usually not less than 8.5 mm).

It is a general aim of the present invention to obviate the above mentioned drawbacks by providing a hinge of the frame type offering wide adjustment possibilities, while having a reduced thickness and being at the same time of easy and cheap construction.

SUMMARY OF THE INVENTION

In view of this aim, in accordance with the invention, a hinge for furniture of the "frame" type has been devised which comprises a base portion to be mounted on the frame of the piece of furniture and a portion for fastening to the furniture door and articulated on the base portion, the base portion comprising a lower element intended for fastening to the furniture frame and an upper element for supporting the articulation to the portion fastening the hinge to the door, the lower and upper elements being connected to each other for mutual-sliding movement in a direction longitudinal to the hinge, means for controlled adjustment of the sliding movement being present close to one end of the base portion, so as to offer front adjustment of the hinge, means for sliding constraint in the adjustment direction being also present close to the other end of the base portion, characterized in that the two base elements are made up of cut-out and bent sheet metal and the sliding-constraint means comprises half-punched pins projecting from side walls of one of the two elements for sliding fitting into corresponding slots in the other element.

BRIEF DESCRIPTION OF THE DRAWINGS

For better explaining the innovative principles of the present invention and the advantages it offers over the known art a possible embodiment applying said principles will be described hereinafter, by way of example, with the aid of the accompanying drawings. In the drawings.

DETAILED DESCRIPTION OF THE INVENTION

Figure 1:
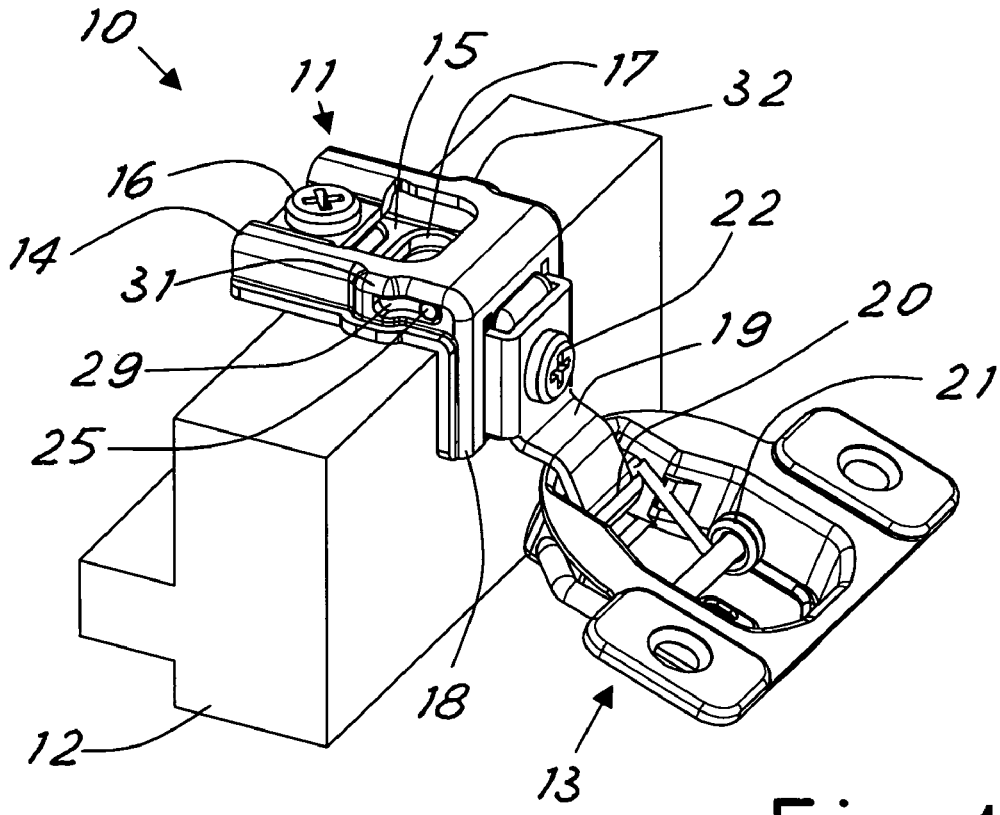
FIG. 1 is a perspective view of a hinge in accordance with the invention.

With reference to the drawings, shown in FIG. 1 is a hinge of the frame type generally denoted at 10 and made following the principles of the present invention.

Hinge 10 comprises a base portion 11 to be fastened to the frame 12 of the piece of furniture and on which a box 13 to be embedded into the furniture door (not shown) is pivotally mounted.

The base portion 11 is made up of two elements or plates 14, 15 slidably coupled with each other, in a direction longitudinal to the base, through use of adjustment and constraint means 16 disposed close to one end of the base to supply front adjustment of the hinge while at the same time preventing the elements from moving apart from each other. This adjustment means advantageously consists of a cam (or a screw) 16 disposed close to the rear end of the base.

The definitions "front, side and vertical adjustments" appearing herein are intended as normally used in the field of furniture hinges, in particular in the case of hinges mounted laterally of the furniture door.

The innermost element 15 is provided with a slot-shaped hole 17 designed to receive a screw (in chain line in FIG. 5) for fastening onto the frame edge, which screw can be manipulated through a corresponding aperture on the upper plate. The slot 17 is elongated transversely of the hinge extension to enable vertical adjustment of the hinge position through loosening of the screw for fastening to the piece of furniture. Advantageously, the slot is at an intermediate position relative to the adjustment means and the front means for sliding constraint between the two base elements.

Advantageously, the outermost element 14 has a front end 18 bent at a right angle and slidably supporting an arm 19 terminating with an articulation 20 on the hinge box 13. A spring 21 may be provided, in accordance with the known art, for reaching and maintaining the extreme positions of open hinge and closed hinge. Between the base end 18 and arm 19 there is a screw or cam 22 to supply adjustment of the mutual position (a vertical adjustment in FIG. 1). This adjustment therefore represents the hinge side adjustment. Such an adjustment system is known by itself and will not be further described.

Alternatively, should this adjustment be judged unnecessary, arm 19 can be in a one-piece construction with or rigidly connected to the base element 14.

Figure 2:
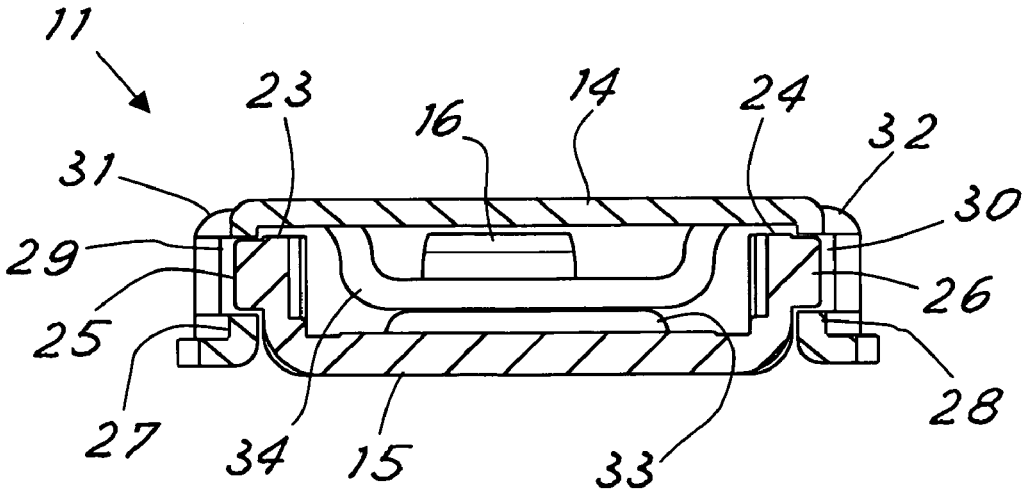
FIG. 2 is a cross-section view of the hinge base, taken along line II-II in FIG. 3.

As clearly seen in section in FIG. 2, the lower base element 15 is made of metal sheet with the two side flaps 23 and 24 upwardly bent at a right angle. Opposite pins 25 and 26 are formed on the bent flaps 23 and 24, on the opposite side from the seat of the cam or screw (16); said pins are obtained through generally cylindrical half-punching operations and project outwardly being aligned with each other with respect to an axis transverse to the hinge.

The upper movable plate 14 is preferably made of metal sheet as well and has two side walls 27, 28 bent in the opposite direction relative to flaps 23, 24; the size of said plate is adapted to internally receive plate 15 with a minimum side clearance, enabling guided to-and-fro sliding of same.

Advantageously, a dished portion 33 projecting on the upper surface of plate 15 constitutes a slidable support for a recessed portion 34 of the upper plate 14, at the adjustment cam 16.

Shown in the figures is the preferred embodiment of a front adjustment obtained through use of cam 16 having its shank 35 fitted into a hole 36 of the lower plate 15 and riveted thereon, with a region 37, eccentric to the shank, that is received in a transverse slot 38 in the upper plate 14.

The movable plate 14 on its side walls 27 and 28 has two through slots 29, 30 cut out with substantially the same height as the diameter of the respective half-punched pins 25, 26 and elongated in the to-and-fro sliding direction of the two base elements.

When the hinge is assembled, as shown in FIG. 1, the half-punched pins 25, 26 are slidably received within the elongated through slots 29, 30 so as to form the sliding-constraint front means. The two base elements can slide without however being separated as they are retained at the rear by the screw or cam 16 and at the front by the half-punched pins in the through slots.

Figure 3:
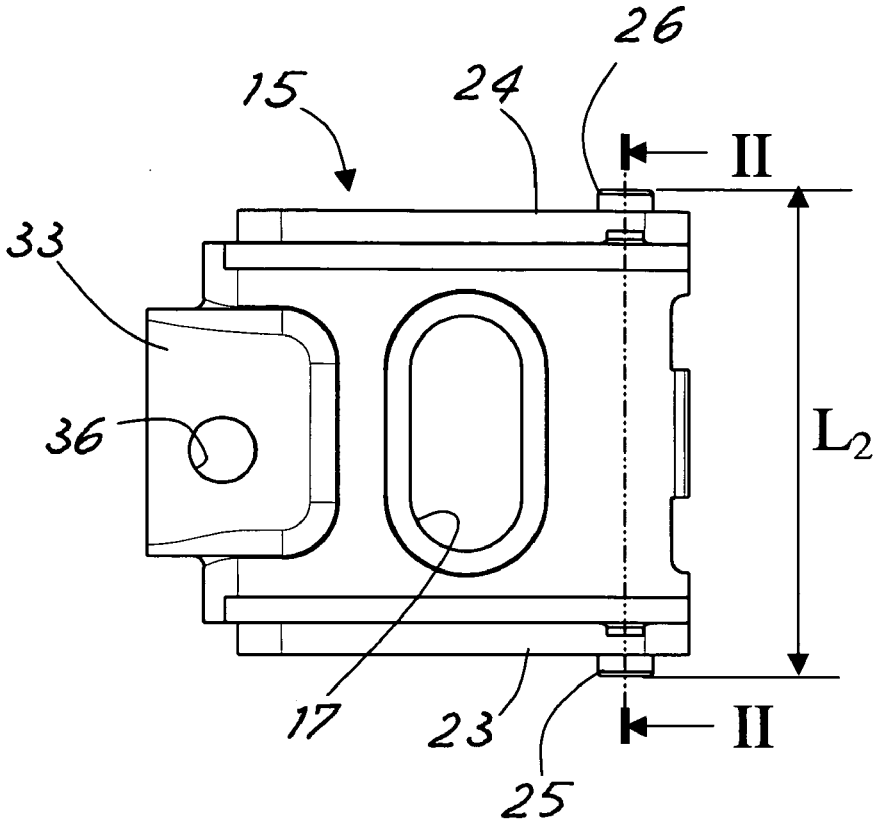
FIG. 3 is a plan view of a lower component of the hinge base portion seen in FIG. 1.
Figure 4:
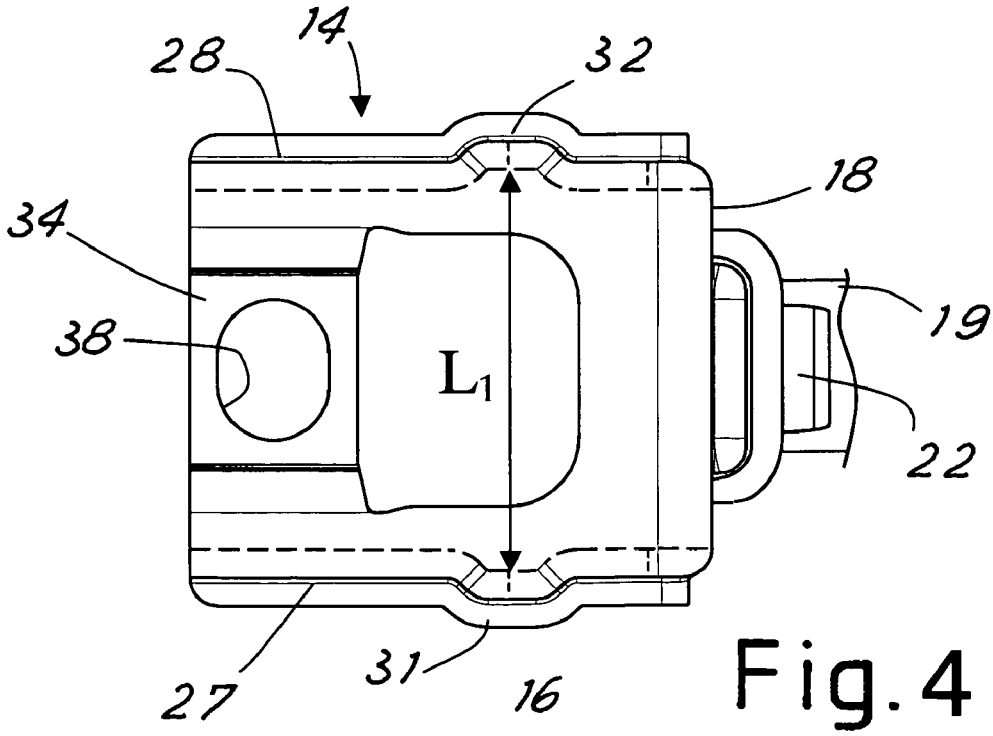
FIG. 4 is a plan view of an upper component of the hinge base portion seen in FIG. 1.

For mounting of the two parts, at the rear end of the through slots 29, 30, the two side walls 27, 28 of the upper element have two outwardly enlarged regions 31, 32. The width $L_1$ (shown in FIG. 4) between the inner walls of the enlarged regions 31, 32 is slightly larger than the overall width $L_2$ (shown in FIG. 3) between the two opposite ends of the half-punched pins 25, 26.

Figure 5:
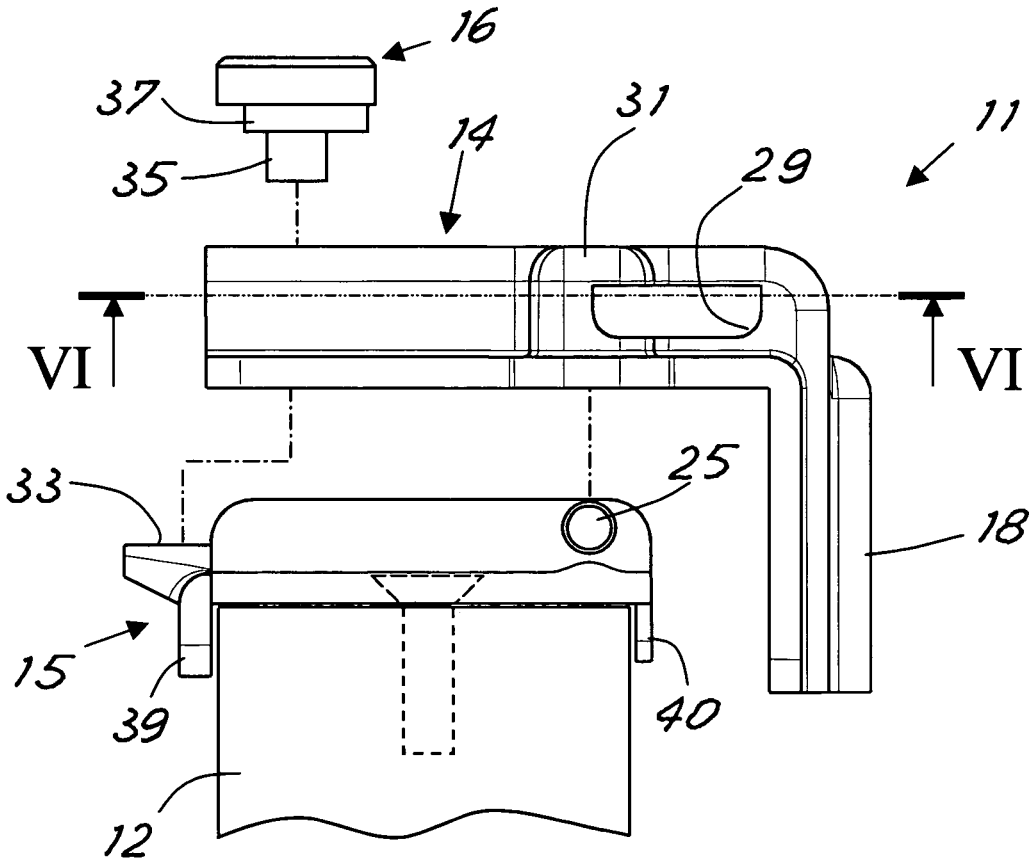
FIG. 5 is an elevation side view, in an exploded representation, of the hinge base portion seen in FIG. 1.
Figure 6:
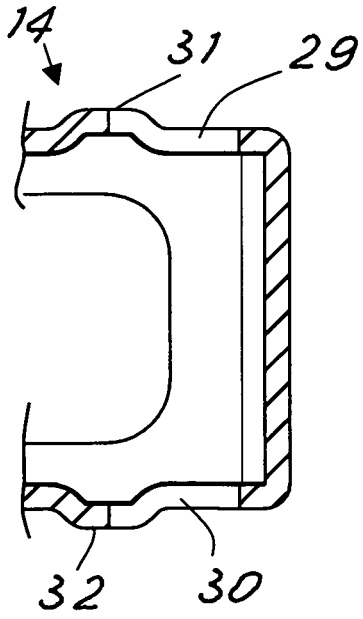
FIG. 6 is a partially sectioned view showing a detail of the component in FIG. 4, taken along line VI-VI in FIG. 5.

In this way, as also clearly visible in the section in FIG. 6, the two slots 29, 30 at their rear ends, have an entrance region for the half-punched pins. Thus mounting can be done easily by inserting the upper plate 14 over the lower plate 15 causing vertical sliding of the half-punched pins 25 and 26 within the enlarged regions 21 and 22 (as shown in FIG. 5) and subsequently horizontally and rearwardly moving the upper plate so that the half-punched pins 25, 26 fit into the narrower region of the guiding through slots 29, 30. The enlarged regions are advantageously obtained by drawing of the walls.

Advantageously, as viewed from FIG. 5, the through slots can have such sizes that when operated for front adjustment, the half-punched pins cannot be brought into the enlarged regions, so that mounting becomes steady and no longer reversible once the two elements are connected by means of the cam or screw 16. Still in FIG. 5 it is possible to see that the lower element can be advantageously provided with tabs 39, 40 projecting downwardly at its front and rear ends to surround the edge of the furniture frame.

At this point it is apparent that the intended purposes have been reached. Since the side half-punched pins 25, 26 do not involve material removal, they can be carried out leaving a minimum space with respect to the upper margins of flaps 23, 24. By adopting suitable die-forming expedients this space can be easily reduced to zero, as diagrammatically shown in the figures.

Likewise, through use of the upper wall of plate 14 as the cutting out die, the through slots 29, 30 can be obtained using punches that are close to tangency with respect to the lower extremity of the side walls 27, 28. At this point it is clear that, although on mounting of the hinge at least one component (a slidable junction pin inserted between the two slidable elements of the base) is made unnecessary with respect to the known art, the hinge in accordance with the invention is of solid and less bulky structure as compared with the known art. The base thickness reduction can be also of 30%, the other features being the same.

Obviously, the above description of an embodiment applying the innovative principles of the present invention is given by way of example only and therefore must not be considered as a limitation of the scope of the patent rights herein claimed.

What is claimed is:

1. A hinge for furniture of the "frame" type comprising a base portion to be mounted on the frame of the piece of furniture and a portion for fastening to a furniture door and articulated on the base portion, the base portion comprising a lower element intended for fastening to the furniture frame and an upper element for supporting the articulation to the portion fastening the hinge to the door, the lower and upper elements being connected to each other for mutual-sliding movement in a direction longitudinal to the hinge, means for controlled adjustment of this sliding movement being present close to one end of the base portion, so as to offer front adjustment of the hinge, means for sliding constraint in the adjustment direction being also present close to the other end of the base portion, characterized in that the two base elements are made up of cut-out and bent sheet metal and the sliding-constraint means comprises half-punched pins formed on side walls of one of the two elements and projecting from said side walls for sliding fitting into corresponding slots in the other element, characterized in that the half-punched pins project outwardly from side walls of the lower element which is received between side walls of the upper element in which the slots are present, and characterized in that, to enable introduction of the half-punched pins into the slots, the side walls of the upper element have enlarged regions for passage of the half-punched pins from the lower edge of the upper element to the slots.

2. A hinge as claimed in claim 1, characterized in that the range of normal regulation of the adjustment means does not allow the half-punched pins to slide along the respective slots until reaching the enlarged regions.

3. A hinge as claimed in claim 1, characterized in that the side walls of the lower element project upwardly while the side walls of the upper element project downwardly.

4. A hinge as claimed in claim 1, characterized in that the half-punched pins are substantially formed flush with upper edges of the side walls of the lower element.

5. A hinge as claimed in claim 1, characterized in that the adjustment means is cam means.

6. A hinge as claimed in claim 1, characterized in that the upper element has a front end bent to an L-shaped configuration supporting the articulation.

7. A hinge as claimed in claim 6, characterized in that the articulation is fastened to the L-bent front end through position adjustment means for side adjustment of the hinge.

8. A hinge as claimed in claim 1, characterized in that the lower element has a slot for a fastening screw to the piece of furniture, which slot extends transversely of the hinge extension for vertical adjustment of said hinge.

9. A hinge as claimed in claim 8, characterized in that the slot for the fastening screw is at an intermediate position relative to the sliding-constraint means and the front adjustment means.

* * * * *